United States Patent [19]

Eckert

[11] Patent Number: 4,714,494

[45] Date of Patent: Dec. 22, 1987

[54] TROUGH SHEAR DIFFUSOR APPARATUS FOR FLUXING MOLTEN METAL AND METHOD

[75] Inventor: Charles E. Eckert, Plum Boro, Pa.

[73] Assignee: Aluminum Company of America, Pittsburgh, Pa.

[21] Appl. No.: 939,145

[22] Filed: Dec. 8, 1986

[51] Int. Cl.[4] ..... C21C 7/00

[52] U.S. Cl. ..... 75/66; 75/59.1; 75/68 R; 75/93 R; 266/220

[58] Field of Search ..... 75/59.1, 66, 49, 68 R, 75/93 R; 266/220

[56] References Cited

U.S. PATENT DOCUMENTS

| | | | |
|---|---|---|---|
| 2,826,489 | 3/1958 | Wagner | 75/59.1 |
| 3,227,547 | 1/1966 | Szekely | 75/59.1 |
| 3,743,263 | 7/1973 | Szekely | 266/225 |
| 3,839,019 | 10/1974 | Bruno et al. | 75/68 R |

*Primary Examiner*—Peter D. Rosenberg

*Attorney, Agent, or Firm*—Andrew Alexander; John P. Taylor

[57] ABSTRACT

A system for purification of molten metal to remove impurities such hydrogen gas and alkali elements therefrom is disclosed which comprises passing the molten metal through an enclosed passageway at a velocity of at least about 0.1 cm/sec and introducing a sparging gas into the passageway whereby the velocity of the molten metal will shear off bubbles of the sparging gas as they are formed resulting in smaller bubbles with larger gas/-molten metal interface area to achieve maximum contact between the sparging gas and the molten metal to enhance removal of impurities from the molten metal.

18 Claims, 6 Drawing Figures

TROUGH SHEAR DIFFUSOR APPARATUS FOR FLUXING MOLTEN METAL AND METHOD

BACKGROUND OF THE INVENTION

1. Field of the Invention

This invention relates to the fluxing of molten metals such as aluminum and alkali materials, e.g., Na, K, Ca, to remove impurities. More particularly, this invention relates to the removal of impurities such as hydrogen gas from molten alkali metals and molten metals such as a molten aluminum base alloy using a sparging gas in a system without moving parts.

2. Description of the Related Art

The production of aluminum base alloys has become of increasing interest due to the combination of lightweight and high strength which such an alloy can be made to possess. However, the formation of some aluminum base alloys is significantly more difficult than that of other aluminum base alloys due to the rapid adsorption of hydrogen gas by some alloys: reaction of some alloys with refractory linings in the furnace; and composition gradients in the cast ingot due to the propensity of some alloying metals to oxidize during processing of the molten alloy after the addition of the alloying metal.

The need for uniformity of composition usually requires stirring which may promote oxidation as well as further hydrogen absorption. The molten mixture is, therefore, preferably degassed after the mixing step to lower the impurity content of the melt by bubbling a sparging gas through the molten metal.

If the removal of impurities from the molten metal mixture is to be effective, however, it is important that there be intimate mixing between the sparging gas and the molten metal. Bruno et al. U.S. Pat. No. 3,839,019 discloses a process for purifying aluminum with chlorine gas using a particular apparatus with agitators and baffles to promote contact between the gas and the metal to be purified. Szekely U.S. Pat. Nos. 3,743,263 and 3,870,511 describe apparatus capable of purifying aluminum using inert gas which is introduced below the surface of the molten metal through a central passageway formed within a rotor which subdivides the gas into discrete gas bubbles and induces a circulation pattern within the molten metal which causes intense stirring.

It would, however, be desirable to provide a system which will optimize the mixing of the sparging gas and the molten metal or alkali material to maximize the efficiency of the removal of impurities therefrom using a passive impurity removal system integrated with the metal transport system and which would require no moving parts.

SUMMARY OF THE INVENTION

It is, therefore, an object of the invention to provide an improved system for degasification of a molten metal to remove impurities therefrom.

It is another object of the invention to provide an improved system for degasification of a molten metal to remove impurities therefrom by introducing a sparging gas into a flowing stream of molten metal in a direction normal to the molten metal flow.

It is yet another object of the invention to provide an improved system for degasification of a molten metal to remove impurities therefrom by introducing into a stream of molten metal flowing at a bulk velocity of at least 0.25 cm/sec a sparging gas in a direction normal to the molten metal flow whereby the velocity of the molten metal flow will shear off the bubbles of sparging gas as they are formed and before they coalesce into larger bubbles to thereby increase the interfacial contact area between the sparging gas and the molten metal.

It is a further object of the invention to provide an improved system for degasification of a molten metal to remove impurities therefrom by introducing into a stream of molten metal flowing at a bulk velocity of at least about 0.1 cm/sec, preferably at least 1.5 cm/sec, a sparging gas in a direction normal to the molten metal flow and at a flow of about 2–25 cubic feet/hour/square inch whereby the velocity of the molten metal flow will shear off the bubbles of sparging gas as they are formed and before they coalesce into larger bubbles to thereby increase the interfacial contact area between the sparging gas and the molten metal.

These and other objects of the invention will be apparent from the following description and accompanying drawings.

In accordance with the invention, a system for fluxing or purification of molten metal to remove impurities therefrom comprises passing the molten metal through an enclosed passageway at a bulk velocity of at least about 0.25 cm/sec and introducing a sparging gas into the passageway in a direction normal to the flow of the molten metal whereby the velocity of the molten metal will shear off bubbles of the sparging gas as they are formed resulting in smaller bubbles with larger gas/-molten metal interface area to achieve maximum contact between the sparging gas and the molten metal to enhance removal of impurities from the molten metal.

DETAILED DESCRIPTION OF THE INVENTION

Figure 1:
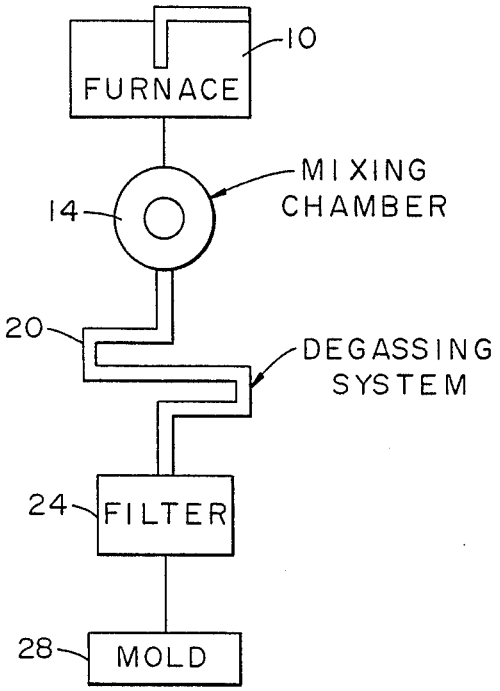
FIG. 1 is a diagramatic flow sheet of a molten metal process showing the degassing system of the invention.

Referring to FIG. 1, the molten media, such as, for example, aluminum or alkali elements, is heated in a furnace 10 and the molten metal is then transported to a mixing chamber 14 where it can be mixed with other alloying materials. The molten metal alloy is then passed through the degassing system 20 of the invention and then filtered at 24 to remove any solids before introducing the molten mixture into a mold 28.

The degassing system of the invention provides an efficient way of passing a degassing stream of a sparging gas through molten metal to remove undesirable impurities such as, for example, trace elements or hydrogen gas which may be present in the molten metal. Basically, the system of the invention comprises introducing a sparging gas into the molten metal while exposing the gas stream to a shear force to cause the gas stream to break up into small bubbles by inhibiting the growth of larger bubbles. The shear force can be approximately normal to the gas flow or it can be at an angle with respect to the gas flow. In any event, the shear force must be capable of detaching or shearing the bubbles as they are formed to avoid formation of larger bubbles. The small bubbles of sparging gas provide a larger total surface area, and thus a larger interfacial contact area, than would be provided if the equivalent amount of gas were dispersed as large bubbles. Thus, a larger surface area of sparging gas is exposed to the molten metal to enhance the efficiency of impurity removal by the sparging gas from the molten metal.

The sparging gas used may comprise a non-reactive gas such as nitrogen or one of the rare gases, e.g., helium, neon, argon, krypton, or xenon. Alternatively, the sparging gas may comprise a reactive gas such as a halogen gas or a reactive halogen-containing gas such as $SF_6$ or $C_2F_6$ which will react with trace elements to form a solid halide removable with the sparging gas, e.g., chlorine which will react with sodium impurities to form NaCl.

Figure 2:
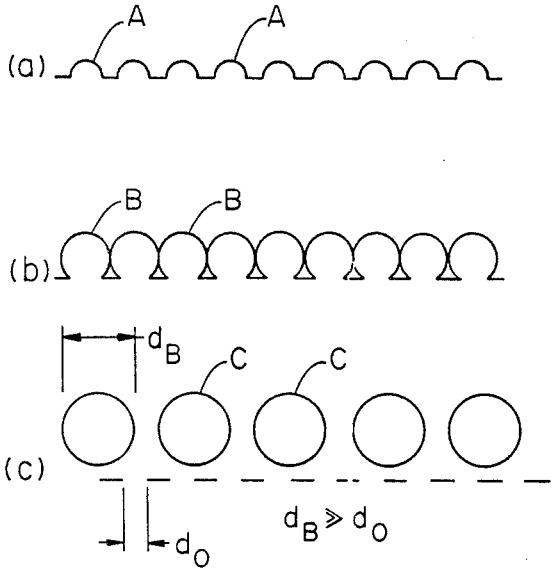
PRIOR ART FIG. 2
FIG. 2 is a fragmentary side section view showing bubble formation in accordance with the prior art.

As shown in FIG. 2, in a conventional gassing system representative of the prior art, bubbles A, under certain conditions, initially form as shown at (a) having a diameter approximating the diameter $d_O$ of the opening through which the gas enters. These bubbles continue to grow, as in (b), into bubbles B wherein the bubble size is large enough that the bubbles B begin to touch one another. This, in turn, causes the bubbles to coalesce into even larger bubbles C as shown in (c) wherein bubbles C are shown to have a diameter $d_B$ much larger than the opening $d_O$ through which the gas originally passed.

Figure 3:
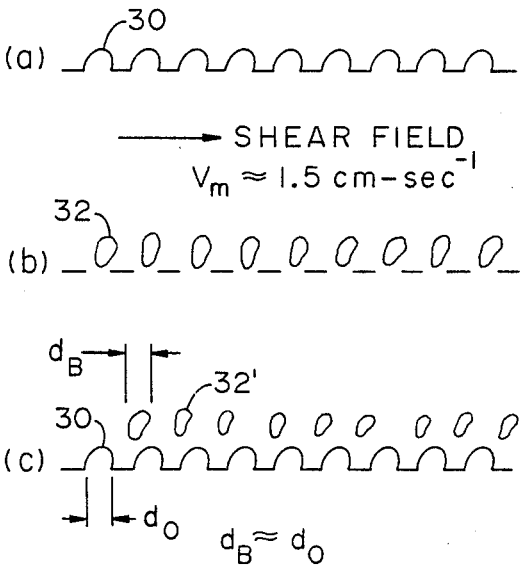
FIG. 3 is a fragmentary side section view showing bubble formation in accordance with the system of the invention.

In contrast, in accordance with the invention, as shown in FIG. 3, bubbles 30 first appear as shown in (a) which are slightly skewed due to the shear velocity to which they are exposed in accordance with the invention. While the shear force distorts the shape of bubble 30 in contrast to bubble A of the prior art, the overall size is still similar.

However, the action of the shear force against the emerging bubble is much more evident in (b) wherein bubble 32 is quite elongated and is already starting to separate from the gas stream coming through the opening. Bubble 32' as shown in (c), has already separated from the gas stream and a new bubble 30 is emerging in contrast to the large bubbles B or the even larger coalesced bubbles C of the prior art. It will be noted that buoyancy forces impart a vertical velocity component to bubble 32 while the shear forces are acting upon the bubble normal to the vertical resulting in the illustrated bubble trajectory.

Figure 4:
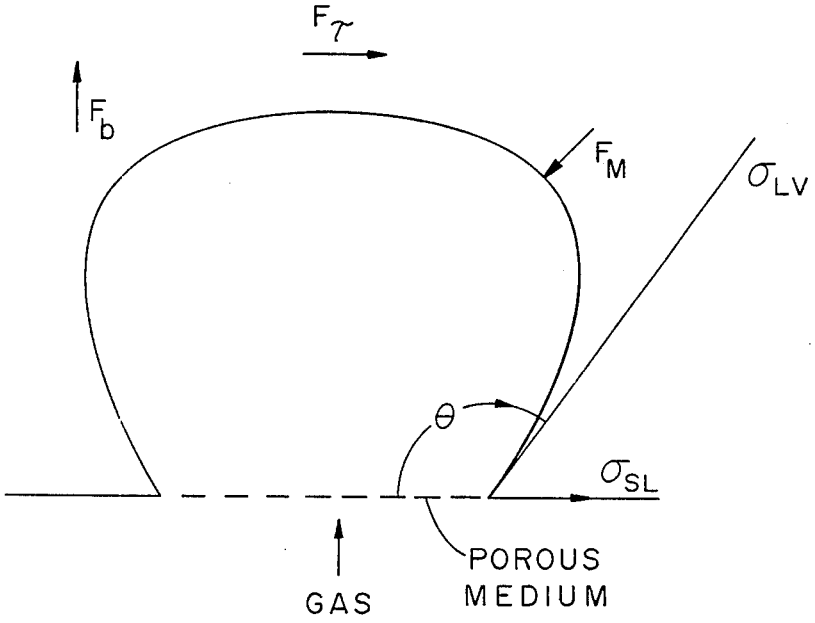
FIG. 4 is a fragmentary side section view showing forces which act upon a gas bubble as it is formed.

In FIG. 4, the various forces acting upon the gas bubble 30 are shown in vector form wherein $F_b$ represents the buoyancy forces, $F_M$ is the metallostatic force, $\sigma_{LV}$ and $\sigma_{SL}$ represent interfacial tension, and $\theta$ represents the contact angle of the surfaces forces. Acting against these forces are the shear forces F. It has been found, as referred to in FIG. 3, that a molten metal stream velocity of 0.25 cm/sec, for example, normal to the gas flow will provide sufficient force acting against the bubble to cause the bubble to separate from the pore into a separate discrete bubble while the overall diameter of the bubble may still be approximately the same diameter as the opening from which the gas stream emerged.

Preferably, the velocity of the molten metal stream should be from about 2.5 cm/sec up to about 4 cm/sec. The velocity of the molten metal stream, however, with respect to the sparging zone, must permit a residence time of the molten metal within the sparging zone of at least about 20 seconds, preferably, about 40–80 seconds. Thus, to maintain the minimum metal velocity to achieve the desired minimum residence time, it may be necessary to extend the length of the sparging zone.

Figure 6:
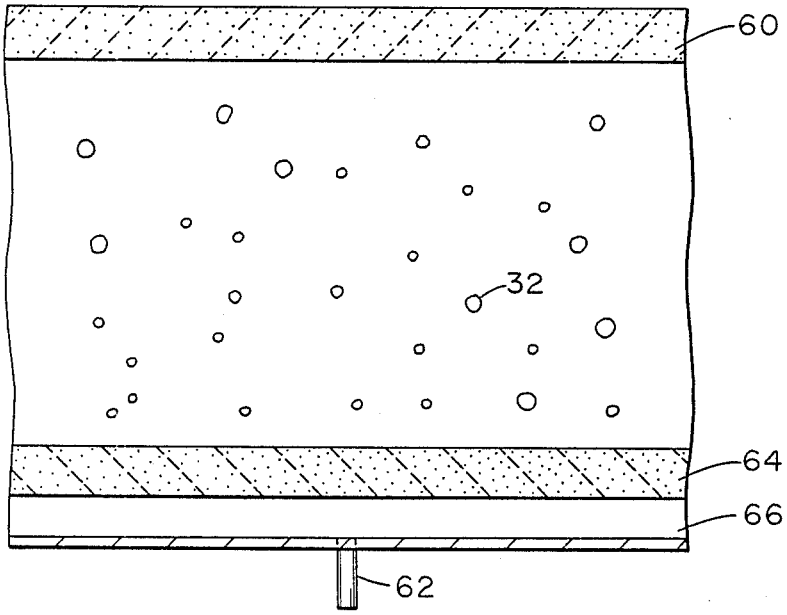
FIG. 6 is a fragmentary side section view of a portion of the apparatus shown in FIG. 5.
Figure 5:
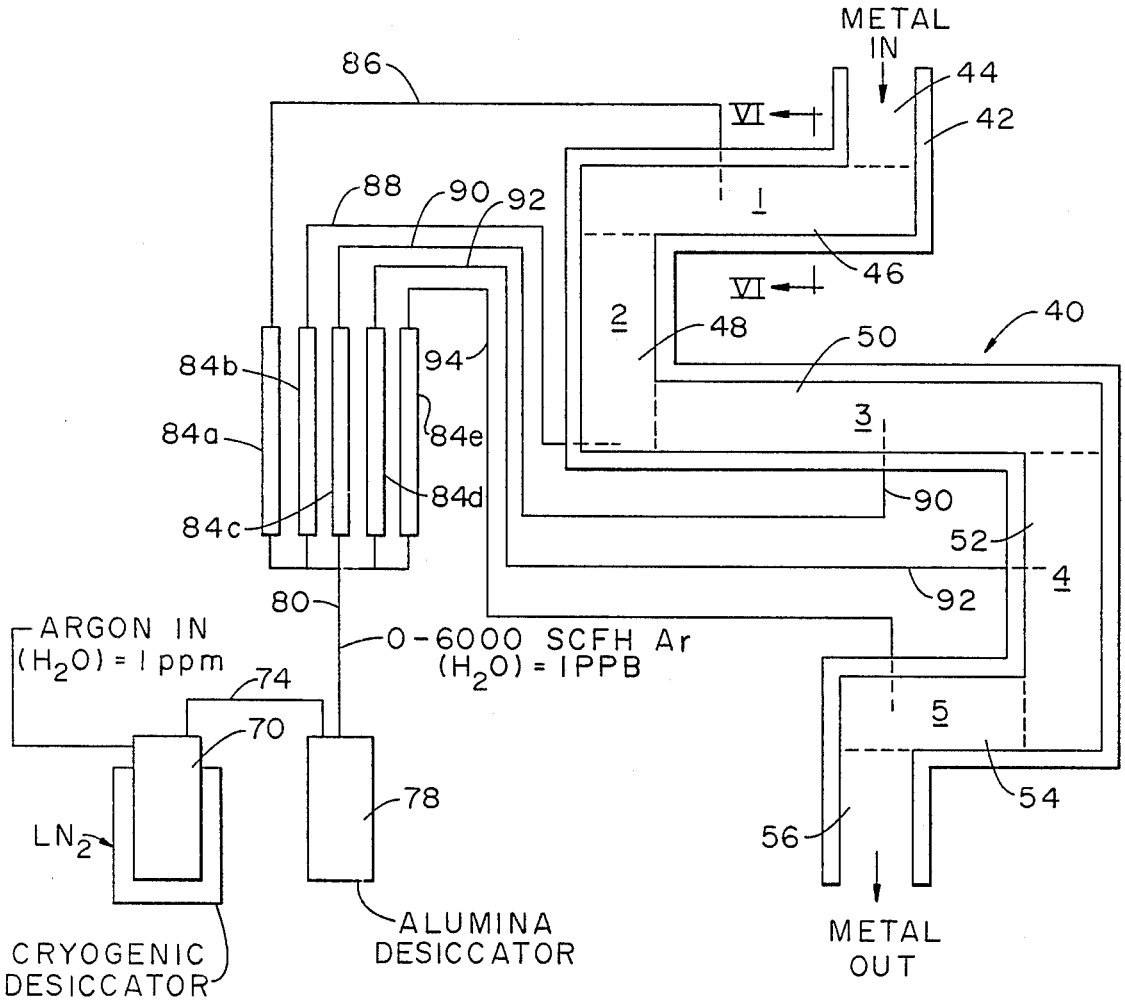
FIG. 5 is a top view showing apparatus used in the system of the invention.

Turning now to FIGS. 5 and 6, apparatus for implementing the system of the invention is illustrated. As shown in FIG. 5, the sparging zone comprises a passageway or trough which is generally indicated at 40 comprising sidewall 42 together with a top wall 60 and bottom walls which will be described below. Trough 40 is divided into an inlet section 44, an outlet section 56, and five degassing sections 46, 48, 50, 52, and 54.

A sparging gas, such as non-reactive argon, having a low water content, e.g., about 1 ppm or less, is fed under pressure from an external source (not shown) into a cryogenic desiccator or "cold trap" 70 using liquid nitrogen or other suitable coolant to trap liquids in the gas.

The gas passes from cold trap 70 via line 74 into an alumina desiccator 78. The gas emerging from desiccator 78 via line 80 should now have a moisture content significantly lower. The dried gas is now fed into five separate Rotameters **84*a*–84*e*, i.e., gas flow rate measuring devices, from which the gas is fed respectively into degassing sections 46, 48, 50, 52, and 54 through lines 86, 88, 90, 92, and 94**.

As best seen in FIG. 6, each of the five degassing sections 46–54 of the sparging zone comprises, in addition to sidewalls 42, a porous top wall 60, a porous bottom wall 64, and a plenum 66 beneath porous bottom wall 64 through which the sparging gas is admitted through inlet 62.

Porous bottom wall 64 and top wall 60 preferably comprise a porous ceramic material which will not react with the particular metal alloy flowing through trough 40. However, it has been found that the gas flow through the system provides a protective film which inhibits attack of the porous ceramic material by the molten metal. For example, when the metal alloy comprises an aluminum base alloy, porous ceramic top walls 60 and bottom walls 64 typically may comprise a phosphate bonded chromia-alumina media or porous silicon carbide. Sidewalls 42 of trough 40, although non-porous, may be formed of or lined with the same ceramic material used to form the porous bottom and top walls of trough 40.

The porosity of the ceramic bottom wall 64 should be greater than 2% and the specific permeability, i.e., the flow rate which can be developed at a given pressure drop at unit thickness and area, can be at least about 2.0 $cm^2$, preferably 7 to 14 $cm^2$, to permit sufficient flow of sparging gas therethrough. With respect to sparging gas flow, it has been found that the flow rate should be sufficiently high to provide a gas holdup value (defined as the volume of sparging gas divided by the total contained volume of metal being sparged, i.e., the volume of trough 40) of about 0.98. Preferably, the flow rate of sparging gas should be from 2–25 $ft^3/hr/in^2$ of the area of the sparging zone.

The resulting sparging system of the invention has been found to be capable of lowering the hydrogen gas volume in an aluminum base alloy containing 1 wt. % magnesium from above 0.45 down to 0.10 $ccH_2$ (stp)/100 g aluminum when the sparging gas rate was at least 6 $ft^3/hr/in^2$ and the velocity of molten metal flowing normal to the sparging gas was at least 1.5 cm/sec.

Having thus described the invention, what is claimed is:

1. A method for removing impurities from a molten metal which comprises:

(a) flowing molten metal at a velocity of at least 0.1 cm/second through an enclosed passageway having an inlet section and an outlet section and consisting essentially of a top wall, sidewalls, and a bottom wall, at least one of such walls further comprising one or more porous portions through which said molten metal flows;

(b) introducing into said enclosed passageway, through said porous wall portion, in a direction generally normal to the flow of molten metal in said passageway, gas capable of removing impurities from said molten metal within said enclosed passageway;

whereby the velocity of said molten metal flow through said porous wall portion normal to said gas flow will be capable alone of detaching gas bubbles as they are formed in said passageway, in the absence of moving parts in said passageway, resulting in smaller bubbles with larger gas/metal interface to achieve high contact area between said gas and said molten metal to thereby remove said impurities from said molten metal.

2. A method for removing hydrogen gas from a molten aluminum base alloy comprising:

(a) flowing said molten aluminum base alloy at a rate of at least 2.5 cm/sec through an enclosed passageway having an inlet section and an outlet section and cormprising sidewalls and porous top and bottom walls; and (b) introducing into said passageway, at one or more points between said inlet section and said outlet section, through said porous bottom wall in a direction normal to the flow of said molten metal through said enclosed passageway, a gas selected from the class consisting of a halogen-containing gas, nitrogen, helium, neon, argon, krypton, xenon, and a gas capable of reacting with an impurity to form a gaseous product at a rate of from 2–25 $ft^3/hr/in^2$;

whereby said gas passing through said porous bottom wall will form bubbles in said passageway and said velocity of said molten aluminum base alloy flowing in said enclosed passageway parallel to said porous bottom wall will shear said bubbles from said porous bottom wall prior to growth of said bubbles into large bubbles to thereby increase the area of gas/metal interface.

3. Apparatus for removing impurities from molten metal which comprises:

(a) an enclosed passageway having an inlet section and an outlet section and consisting esentially of a top wall, sidewalls, and a bottom wall, at least one of such walls further comprising one or more porous portions through which flows molten metal at a velocity of at least 0.1 cm/second;

(b) means for introducing into said enclosed passageway through said porous wall portion, in a direction generally normal to the flow of said molten metal in said passageway, gas capable of removing impurities from said molten metal within said enclosed passageway;

whereby the velocity of said molten metal flow through said porous wall portion normal to said gas flow will be capable alone of detaching has bubbles as they are formed in said passageway, in the absence of moving parts in said passageway, resulting in smaller bubbles with larger gas/metal interface to achieve high contact area between said gas and said molten metal to thereby remove said impurities from said molten metal.

4. The method of claim 1 wherein said velocity of said molten metal comprises at least 0.25 cm/sec.

5. The method of claim 4 wherein said step of introducing said gas into said passageway further comprises introducing said gas through a porous wall in said passageway.

6. The method of claim 5 wherein said porous wall has a porosity of greater than 2%.

7. The method of claim 4 wherein said step of introducing said gas into said passageway through a porous wall in said passageway further comprises introducing said gas into a plenum located adjacent said porous wall and then through said porous wall into said passageway.

8. The method of claim 5 wherein said step of introducing said gas into said passageway comprises introducing said gas through at least a portion of the wall of said passageway at a rate of from about 2 to 25 $ft^3/hr/in^2$ of passageway area.

9. The method of claim 8 wherein said step of introducing said gas into said passageway comprises introducing into said passageway a sparging gas selected from the group consisting of a halogen-containing gas, nitrogen, helium, neon, argon, krypton, and xenon.

10. The method of claim 8 wherein said step of introducing said gas into said passageway comprises introducing into said passageway a gas capable of reacting with any impurities present in said molten metal to form a reaction product removable from said molten metal with said gas.

11. A method for removing hydrogen gas from a molten aluminum base alloy mixture comprising:

(a) passing said molten aluminum base alloy at a rate of at least 2.5 cm/sec through a passageway having a porous wall; and (b) introducing into said passageway a gas selected from the class consisting of a halogen-containing gas, nitrogen, helium, neon, argon, krypton, xenon, and a gas capable of reacting with an impurity to form a gaseous product at a rate of from 2–25 $ft^3/hr/in^2$;

whereby said gas passing through said porous wall will form bubbles in said passageway and said velocity of said flowing molten aluminum base alloy will shear said bubbles from said porous wall prior to growth of said bubbles into large bubbles to thereby increase the area of gas/metal interface.

12. Apparatus for removing hydrogen from a molten metal by flowing gas through said molten metal which comprises:

(a) an enclosed passageway through which a molten metal mixture may be passed at a velocity of at least 0.25 cm/sec to permit shearing of gas entering said passageway; and (b) means for introducing into said passageway a gas capable of removing hydrogen from said molten metal;

whereby the velocity of said flowing molten metal will inhibit growth of gas bubbles as they are formed in said passageway resulting in smaller bubbles with larger gas/metal interface area to achieve maximum contact area between said gas and said molten metal.

13. The apparatus of claim 12 wherein said means for introducing into said passageway a gas capable of removing hydrogen from said molten metal comprises openings in at least one wall of said passageway.

14. The apparatus of claim 12 wherein said means for introducing into said passageway normal to the flow of molten metal therein a gas capable of removing hydrogen from said molten mctal comprises at least one porous wall in said passageway.

15. The apparatus of claim 3 wherein the porosity of said porous wall is sufficient to permit the flow of gas into said passageway at a rate of from about 2-25 $ft^3/hr/in^2$ of said porous wall to permit efficient removal of hydrogen in said molten metal flowing through said passageway.

16. The apparatus of claim 3 wherein the porosity of said porous wall is greater than 2% and a permeability of at least 2.0 $cm^2$.

17. The apparatus of claim 3 wherein said porous wall comprises a porous ceramic material selected from the class consisting of a phosphate bonded chromia-alumina ceramic and silicon carbide.

18. The apparatus of claim 3 wherein the porosity of said porous wall is greater than 2% and a permeability of at least 7 to 14 $cm^2$.

* * * * *